United States Patent [19]

Iizuka et al.

[11] 4,345,571

[45] Aug. 24, 1982

[54] INTERNAL COMBUSTION ENGINE

[75] Inventors: Haruhiko Iizuka, Yokosuka; Fukashi Sugasawa, Yokohama, both of Japan

[73] Assignee: Nissan Motor Company, Limited, Yokohama, Japan

[21] Appl. No.: 135,072

[22] Filed: Mar. 28, 1980

[30] Foreign Application Priority Data

Mar. 30, 1979 [JP] Japan ..... 54-37781

[51] Int. Cl.[3] ..... F02M 25/06; F02D 17/02

[52] U.S. Cl. ..... 123/568; 123/198 F; 123/571

[58] Field of Search ..... 123/568, 571, 198 F

[56] References Cited

U.S. PATENT DOCUMENTS

| | | | |
|---|---|---|---|
| 3,765,394 | 10/1973 | Francis . | |
| 3,779,013 | 12/1973 | Faber et al. . | |
| 4,114,577 | 9/1978 | Aoyama . | |
| 4,137,874 | 2/1979 | Otsubo et al. . | |
| 4,143,635 | 3/1979 | Izuka et al. . | |
| 4,249,374 | 10/1981 | Sugasawa | 123/568 X |
| 4,304,208 | 12/1981 | Etoh et al. . | |
| 4,316,438 | 2/1982 | Iizuka . | |

FOREIGN PATENT DOCUMENTS

| | | |
|---|---|---|
| 2452596 | 3/1980 | France . |
| 386564 | 1/1933 | United Kingdom . |
| 1411352 | 10/1975 | United Kingdom . |
| 1426912 | 3/1976 | United Kingdom . |
| 14333464 | 4/1976 | United Kingdom . |
| 1444616 | 8/1976 | United Kingdom . |

OTHER PUBLICATIONS

"mot Technik", Feb. 1979, pp. 36–38.

*Primary Examiner*—Wendell E. Burns

*Attorney, Agent, or Firm*—Schwartz, Jeffery, Schwaab, Mack, Blumenthal & Koch

[57] ABSTRACT

An internal combustion engine is disclosed which includes active cylinders which are always active and inactive cylinders which are inactive when the engine load is below a predetermined value. The engine has an intake passage divided into first and second branches connected to active and inactive cylinders, respectively. The second branch is provided near its inlet with a stop valve and is connected through an EGR passage to the engine exhaust passage. Means are provided to attenuate pressure waves resulting from exhaust pulsations and propagated through the EGR passage toward the second intake passage branch.

7 Claims, 6 Drawing Figures

INTERNAL COMBUSTION ENGINE

BACKGROUND OF THE INVENTION

1. Field of the Invention

This invention relates to a split type internal combustion engine having its intake manifold divided into a first intake passage leading to its active cylinders and a second intake passage leading to its inactive cylinders and having therein a stop valve, the second intake passage being charged with exhaust gases during a split cylinder mode of operation.

2. Description of the Prior Art

It is generally known that internal combustion engines demonstrate higher fuel combustion and thus higher fuel economy when running under higher load conditions. In view of this fact, split type internal combustion engines have already been proposed as automotive vehicle engines or the like subject to frequent engine load variations. Such split type internal combustion engines include active cylinders which are always active and inactive cylinders which are inactive when the engine load is below a given value. The intake passage is divided into first and second branches, the first branch being associated with the active cylinders and the second branch associated with the inactive cylinders and provided with a stop valve. During low load conditions, the stop valve is closed to cut off the flow of air to the inactive cylinders so that the engine operates only on the active cylinders. This relatively increases active cylinder loads resulting in high fuel ecomony.

A split type internal combustion engine has been proposed which is associated with an exhaust gas recirculation system for re-introduction of a great amount of exhaust gases into the inactive cylinders to minimize inactive cylinder pumping losses during a split engine operation for much higher fuel economy.

One difficulty with such a split type internal combustion engine is the possibility of leakage of the re-introduced exhaust gases through the stop valve from the first intake passage branch into the second intake passage branch, resulting in unstable active cylinder operation during a split engine operation where a great pressure differential appears across the stop valve.

In order to prevent such exhaust gas leakage, it has been attempted to use a valve such as a poppet valve having high fluid sealability. However, this requires a large-sized valve drive means capable of providing a force large enough to drive the poppet valve. Another attempt has been made to introduce air, instead of exhaust gases, into the second intake passage branch to minimize inactive cylinder pumping losses during a split cylinder mode of operation. In this attempt, however, cold air is discharged from the inactive cylinders to the catalytic converter normally provided in the exhaust system to spoil its performance.

Such leakage of exhaust gases through the stop valve from the first intake passage branch into the second intake passage branch is mainly due to pressure waves resulting from exhaust pulsations and propagated through the EGR passage to the second intake passage branch to periodically increase the pressure differential across the stop valve between the first and second intake passage branches during a split cylinder mode of operation.

SUMMARY OF THE INVENTION

It is therefore one object of the present invention to provide an improved split type internal combustion engine which is free from the above described disadvantages found in prior art split engines.

Another object of the present invention is to provide an improved split type internal combustion engine which is stable in operation particularly during a split cylinder mode of operation.

BRIEF DESCRIPTION OF THE DRAWINGS

The present invention will be described in greater detail by reference to the following description taken in connection with the accompanying drawings, in which.

DESCRIPTION OF THE PREFERRED EMBODIMENTS

Figure 1:
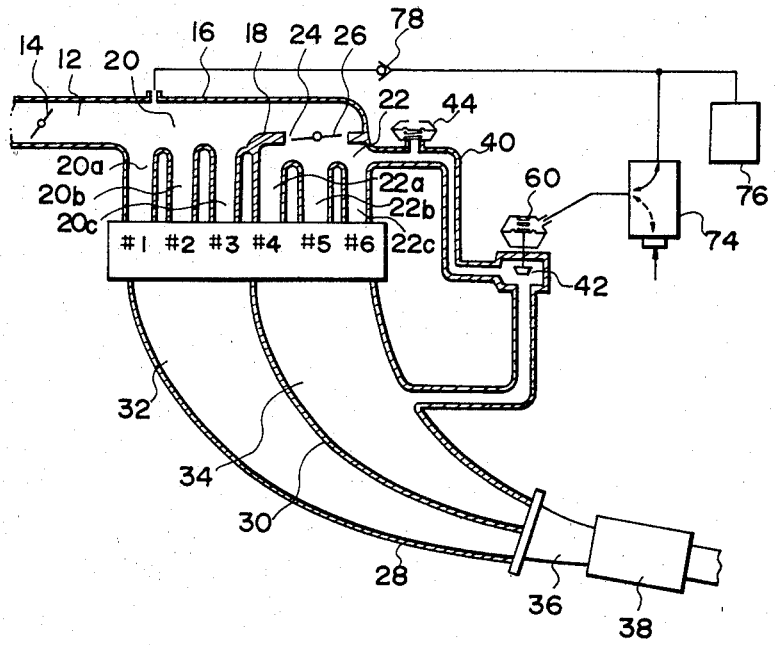
FIG. 1 is a schematic sectional view showing one embodiment of a split type internal combustion engine constructed in accordance with the present invention.

Referring now to FIG. 1, there is illustrated one embodiment of a split engine constructed in accordance with the present invention. The engine includes six cylinders #1 to #6, the first three cylinders #1 to #3 being always "active" and referred to as active cylinders while the other three cylinders #4 to #6 are "inactive" below a predetermined engine load and are referred to as inactive cylinders. Although the engine shown is a six cylinder engine, it is to be noted that the particular engine shown is only for illustrative purposes, and the structure of this invention could be readily applied to any engine structure.

Air to the engine is supplied through an air induction passage 12 provided therein with a throttle valve 14 and connected at its downstream end with an intake manifold 16. The intake manifold 16 is divided by a partition 18 into first and second intake passages 20 and 22. The first intake passage 20 has three branches **20*a* to 20*c* leading to the respective active cylinders #1 to #3, and the second intake passage 22 has three branches 22*a* to 22*c* leading to the respective active cylinders #4 to #6. The second intake passage 22 is provided near its inlet opening 24 with a stop valve 26. The stop valve 26 is adapted to open so as to allow the flow of fresh air into the inactive cylinders #4 to #6 during a six cylinder mode of operation and to close so as to cut off the flow of fresh air to the inactive cylinders #4 to #6** during a three cylinder mode of operation.

The engine also has an exhaust manifold 28 divided by a partition 30 into first and second exhaust passages 32 and 34, the first exhaust passage 32 leading from the active cylinders #1 to #3 and the second exhaust passage 34 leading from the inactive cylinders #4 to #6. The exhaust manifold 28 is connected at its downstream end to an exhaust duct 36 which has therein a catalytic converter 38 to effect oxidation of HC and CO and reduction of NOx so as to minimize the emission of pollutants through the exhaust duct.

An exhaust gas recirculation (EGR) passage 40 is provided which has its one end opening into the second exhaust passage 34 and the other end opening into the second intake passage 22. The EGR passage 40 has therein an EGR valve 42 which is adapted to open so as to allow re-introduction of a great amount of exhaust gases into the second intake passage 22 during a three cylinder mode of operation. A damper 44 is associated with the EGR passage 40 at a position downstream of the EGR valve 42, that is, between the EGR valve 42 and the second intake passage 22, for absorbing or attenuating variations in the pressure of the flow of exhaust gases recirculated through the EGR passage 40 into the second intake passage 22 during a three cylinder mode of operation. Such variations result from exhaust pulsations.

Figure 2:
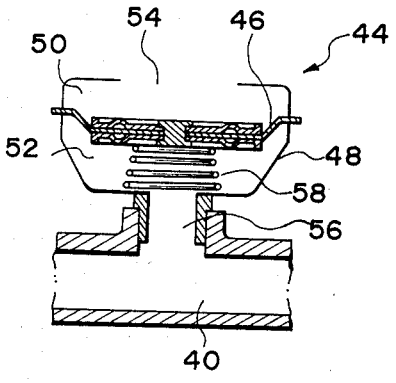
FIG. 2 is a sectional view showing the damper used in the engine of FIG. 1.

Referring to FIG. 2, the damper 44 has a flexible diaphragm 46 spread within a casing 48 to form therewith first and second chambers 50 and 52 on opposite sides of the diaphragm 46. The first chamber 50 communicates with atmospheric air through an opening 54 and the second chamber 52 is connected to the EGR passage 40 through a conduit 56. The conduit 56 has an inner diameter and length substantially equal to the inner diameter of the EGR passage 40. A spring 58 is provided in the second chamber 52 for urging the diaphragm 46 upwardly in the figure. The diaphragm 46 is responsive to a pressure differential between the first and second chambers 50 and 52 to move upwardly or downwardly against the force of the spring 58 so as to vary the volume of the second chamber 52.

Assuming now that the engine is in a three cylinder mode of operation and the EGR valve 42 is open to allow recirculation of a great amount of exhaust gases into the inactive cylinders #4 to #6, pressure waves resulting from exhaust pulsations are propagated within the EGR passage 40 and also within the second chamber 52 of the damper 44 through the conduit 56, the inner diameter of which is substantially equal to that of the EGR passage 40. The pressure waves propagated to the second chamber 52 of the damper 44 periodically vary the pressure in the second chamber 52, so that the second chamber 52 has its volume increased to absorb the pressure increase and decreased to absorb the pressure decrease.

Since the second chamber 52 is connected to the EGR passage 40 through the conduit 56 having an inner diameter and length substantially equal to the inner diameter of the EGR pasage 40, the observed variations in the volume of the second chamber 52 may be considered as equivalent to variations in the volume of the EGR passage 40 near the position at which the conduit 56 opens into the EGR passage 40. Thus, the pressure waves resulting from exhaust pulsations and propagated through the EGR passage 40 toward the second intake passage 22 can be absorbed near the position at which the conduit 56 opens into the EGR passage 40. As a result, the pressure differential appearing across the stop valve 26 between the first and second intake passages 20 and 22 can be held below a predetermined value. Accordingly, it is possible to minimize the amount of exhaust gases leaking through the stop valve 26 from the second intake passage 22 to the first intake passage 20 under no load conditions where the throttle valve 14 is closed and a high vacuum appears in the first intake passage 20 to cause a great pressure differential across the stop valve 26.

Figure 3:
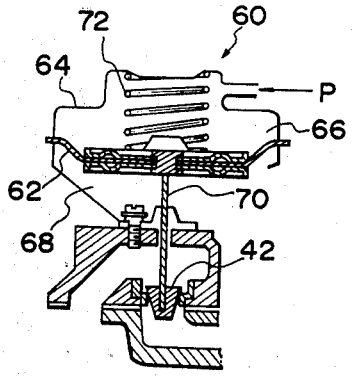
FIG. 3 is a sectional view showing the EGR valve used in the engine of FIG. 1.

The opening and closing of the EGR valve 42 is controlled by a pneumatic valve actuator 60. The valve actuator 60 is best shown in FIG. 3 as including a diaphragm 62 spread within a casing 64 to define therewith first and second chambers 66 and 68 on the opposite sides of the diaphragm 62. A rod 70 is centrally fixed to the diaphragm 62 and extends through the second chamber 68 to the EGR valve 42. A spring 72 is disposed in the first chamber 66 to urge the diaphragm 62 downward. The first chamber 66 is connected to the outlet of a three-way solenoid valve 74 and the second chamber 68 is connected to atmospheric air.

The three-way solenoid valve 74 has an atmosphere inlet communicating with atmospheric air and a vacuum inlet communicating with a vacuum tank 76. The vacuum tank 76 is connected through a check valve 78 to the first intake passage 20 and held above a predetermined vacuum. During a three cylinder mode of operation, the solenoid valve 74 provides communication between its outlet and its vacuum inlet to introduce vacuum into the first chamber 66 of the valve actuator 60 so as to open the EGR valve 42. During a six cylinder mode of operation, the solenoid valve 74 establishes communication between its outlet and its atmosphere inlet to introduce atmospheric pressure into the first chamber 60 of the valve actuator 66 so as to close the EGR valve 42 as shown in FIG. 3.

Figure 4:
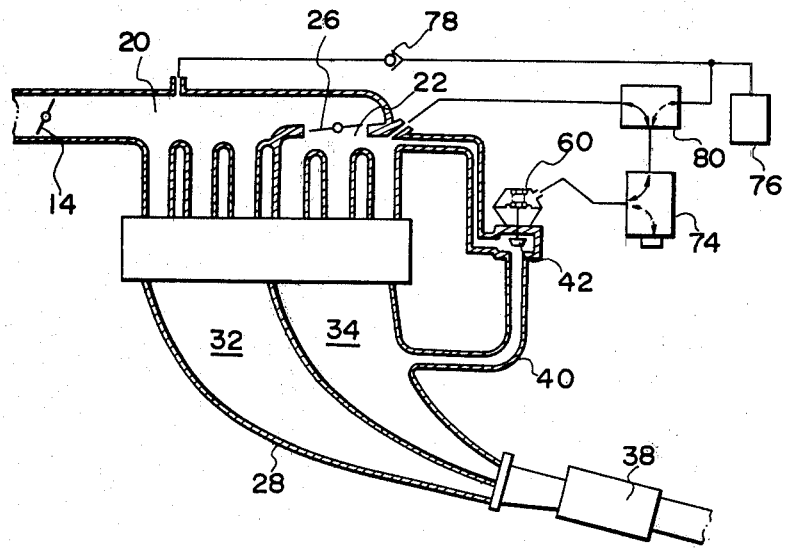
FIG. 4 is a schematic sectional view showing a second embodiment of the present invention.

Referring to FIG. 4, there is illustrated a second embodiment of the present invention with the same elements being designated by the same reference numerals. In this embodiment, the damper 44 is removed and instead a second three-way solenoid valve 80 is provided which has its one inlet communicating with the second intake passage 22, the other inlet communicating with the vacuum tank 76, and its outlet connected to the vacuum inlet of the first solenoid valve 74. The second solenoid valve 80 establishes communication between its one inlet and its outlet to connect the second intake passage 22 through the first solenoid valve 74 to the first chamber 66 of the valve actuator 60 when the throttle valve 14 is at its fully closed position. For this purpose, the second solenoid valve 80 may be associated with a switch adapted to monitor the fully closed position of the throttle valve 14.

Figure 5:
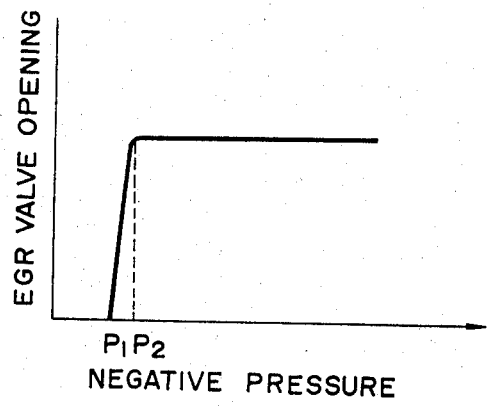
FIG. 5 is a graph used to explain the operation of the EGR valve used in the engine of FIG. 4.

Referring to FIG. 5, the valve actuator 60 is designed to fully close the EGR valve 42 when its first chamber 66 is charged with a negative pressure lower than a first predetermined value $P_1$ and to fully open the EGR valve 42 when it is charged with a negative pressure higher than a second predetermined value $P_1$. If the negative pressure in the second intake passage 22 is below the first predetermined value $P_1$ and the EGR valve 42 is fully closed, the second intake passage negative pressure immediately increases due to piston pumping. When the second intake passage negative pressure reaches the second predetermined value $P_2$, the EGR valve 42 opens to allow recirculation of exhaust gases into the second intake passage 22 so as to decrease the second intake passage negative pressure. This operation is repeated to maintain the second intake passage negative pressure within a range between the first and second predetermined values $P_1$ and $P_2$. That is, the second intake passage pressure is held within a predetermined negative range regardless of pressure waves resulting from exhaust pulsations and propagated through the EGR passage 40. Accordingly, it is possible to minimize the amount of exhaust gases leaking through the stop valve 26 from the second intake passage 22 into the first intake passage 20 during a three cylinder mode of operation.

During a three cylinder mode of operation, except at the fully closed position of the throttle valve, the second solenoid valve 80 operates to provide communication between its outlet and its vacuum inlet connected to the vacuum tank 76. Under such conditions, the first solenoid valve 74 establishes communication between its outlet connected to the first chamber 66 of the valve actuator 60 and its vacuum inlet connected to the outlet of the second solenoid valve 80. Accordingly, the valve actuator 60 has its first chamber 66 charged with a high vacuum from the vacuum tank 76 to open the EGR valve 42.

Figure 6:
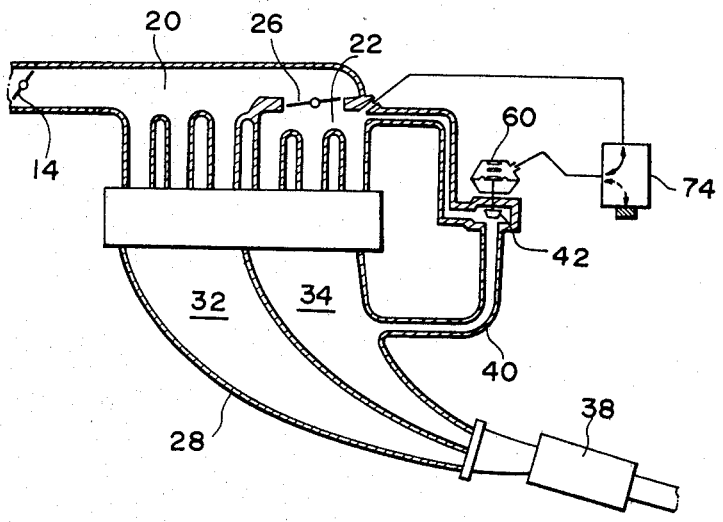
FIG. 6 is a schematic sectional view showing a third embodiment of the present invention.

Referring to FIG. 6, there is illustrated a third embodiment of the present invention in which the same elements are designated by the same reference numerals. This embodiment differs from the second embodiment only in that the vacuum tank 76 and the second solenoid valve 80 are removed and the first solenoid valve 74 has its vacuum inlet connected directly to the second intake passage 22. The valve actuator 60 has its first chamber 66 connected to the second intake passage 22 to open the EGR valve 42 in accordance with the pressure pulsations propagated within the second intake passage 22 to absorb them whether or not the engine is under no load conditions during a three cylinder mode of operation.

Although this embodiment is similar in effect to the second embodiment of FIG. 4 under no load conditions, it is advantageous over the second embodiment in that the EGR valve 42 can be closed a shorter time after the engine operation is shifted from its three cylinder mode to its six cylinder mode and the solenoid valve 74 switches to introduce atmospheric air into the first chamber 66 of the valve actuator 60. The reason for this is that the negative pressure supplied from the second intake passage 22 to the first chamber 66 of the valve actuator 60 is somewhat lower than that supplied thereto from the vacuum tank 76. This improves the responsibility of the EGR valve 42 to rapidly cut off the flow of exhaust gases recirculated into the second intake passage 22 when the engine operation is shifted from its three cylinder mode to its six cylinder mode.

The present invention can suppress the pressure differential occurring across the stop valve between the first and second intake passages during a split cylinder mode of operation by attenuating pressure waves resulting from exhaust pulsations and propagated through the EGR passage toward the second intake passage. This minimizes or eliminates the possibility of leakage of exhaust gases through the stop valve from the second intake passage into the first intake passage. Accordingly, the engine of the present invention is stable in operation particularly during a split cylinder mode of operation.

While the present invention has been described in conjunction with a specific embodiment thereof, it is evident that many alternatives, modifications and variations will be apparent to those skilled in the art. Accordingly, it is intended to embrace all alternatives, modifications and variations that fall within the spirit and broad scope of the appended claims.

What is claimed is:

1. An internal combustion engine comprising:

(a) a plurality of cylinders split into first and second groups;

(b) an air intake passage provided therein with a throttle valve and divided downstream of said throttle valve into first and second branches for supplying air to said first and second groups of cylinders, respectively, said second intake passage branch provided near its inlet with a stop valve normally open to allow the flow of air into said second group of cylinders;

(c) an exhaust passage through which exhaust gases are discharged from said cylinders to the atmosphere;

(d) an EGR passage having its one end opening into said exhaust passage and the other end opening into said second intake passage branch, said EGR passage having therein an EGR valve adapted to normally close so as to interrupt exhaust gas recirculation into said second intake passage branch and to open so as to allow exhaust gas recirculation thereinto when the engine load is below a predetermined value;

(e) split engine control means responsive to engine load conditions for cutting off the supply of fuel to said second group of cylinders and closing said stop valve to cut off the flow of air to said second group of cylinders, thereby rendering said second group of cylinders inactive when the engine load is below the predetermined engine load value; and (f) attenuation means for attenuating pressure waves resulting from exhaust pulsations and propagated through said EGR passage toward said second intake passage branch sufficient to substantially prevent exhaust gases recirculated in said second intake passage branch from escaping through said stop valve into said first intake passage branch when said second group of cylinders is inactive.

2. An internal combustion engine according to claim 1, wherein said attenuation means comprises a damper including a diaphragm spread within a casing to form therewith first and second chambers, said first chamber communicating with atmospheric air and said second chamber communicating through a conduit with said EGR passage.

3. An internal combustion engine according to claim 2, wherein said conduit opens into said EGR passage at a position downstream of said EGR valve.

4. An internal combustion engine according to claim 2, wherein said conduit has an inner diameter and length substantially equal to the inner diameter of said EGR passage at the point where said conduit intersects said EGR passage.

5. An internal combustion engine according to claim 1, wherein said attenuation means comprises:

(a) a pneumatic valve actuator responsive to a negative pressure above a first predetermined value to open said EGR valve and responsive to a negative pressure below a second predetermined value lower than the first predetermined value to close said EGR valve; and (b) a three-way solenoid valve having a first inlet connected to said second intake passage branch, a second inlet connected to atmospheric pressure, and an outlet connected to said valve actuator, said solenoid valve adapted to normally communicate its outlet with its second inlet and to communicate its outlet with its first inlet below the predetermined engine load value.

6. An internal combustion engine according to claim 1, wherein said attenuation means comprises:

(a) a pneumatic valve actuator responsive to a negative pressure above a first predetermined value to open said EGR valve and responsive to a negative pressure below a second predetermined value lower than the first predetermined value to close said EGR valve;

(b) a first three-way solenoid valve having a first inlet, a second inlet connected to atmospheric pressure, and an outlet connected to said valve actuator, said first solenoid valve adapted to normally communicate its outlet with its second inlet and to communicate its outlet with its first inlet below the predetermined engine load value; and (c) a second three-way solenoid valve having a first inlet connected to said second intake passage branch, a second inlet connected through a check valve to said first intake passage branch, and an outlet connected to said first inlet of said first solenoid valve, said second solenoid valve adapted to normally communicate its outlet with its second inlet and to communicate its outlet with its first inlet under no load conditions.

7. An internal combustion engine according to claim 3, wherein said conduit opens into said EGR passage at a position closely adjacent said second intake passage branch.

* * * * *